US011105127B2

(12) United States Patent
Nelsen et al.

(10) Patent No.: US 11,105,127 B2
(45) Date of Patent: Aug. 31, 2021

(54) DUAL ACTUATED LATCH MECHANISM FOR A VEHICLE

(71) Applicants: GM Global Technology Operations LLC, Detroit, MI (US); PyeongHwa Automotive Co., Ltd., Auburn Hills, MI (US)

(72) Inventors: James N. Nelsen, Howell, MI (US); Hee Ra Park, Daegu (KR)

( * ) Notice: Subject to any disclaimer, the term of this patent is extended or adjusted under 35 U.S.C. 154(b) by 434 days.

(21) Appl. No.: 16/179,026

(22) Filed: Nov. 2, 2018

(65) Prior Publication Data

US 2020/0141161 A1 May 7, 2020

(51) Int. Cl.
*E05B 83/24* (2014.01)
*E05B 79/04* (2014.01)
(Continued)

(52) U.S. Cl.
CPC ..... *E05B 83/24* (2013.01); *E05B 79/04* (2013.01); *E05B 79/20* (2013.01); *E05B 81/14* (2013.01); *E05B 85/245* (2013.01); *E05B 85/26* (2013.01)

(58) Field of Classification Search
CPC ..... E05B 83/24; E05B 79/04; E05B 79/20; E05B 81/14; E05B 85/245; E05B 85/26; E05B 83/16; Y10T 292/08; Y10T 292/0801; Y10T 292/081; Y10T 292/0825; Y10T 292/0848; Y10T 292/0855; Y10T 292/083; Y10T 292/0921; Y10T 292/1044; Y10T 292/1047; Y10T 292/1057; Y10T 292/1078; Y10S 292/14
See application file for complete search history.

(56) References Cited

U.S. PATENT DOCUMENTS 2,877,038 A 3/1959 Kramer
2,924,473 A * 2/1960 Krause ..... E05B 83/16 292/11
(Continued)

FOREIGN PATENT DOCUMENTS

CN 205422258 U 8/2016
KR 101882745 B1 * 7/2018
WO WO-2017036850 A1 * 3/2017 ..... E05B 83/24

OTHER PUBLICATIONS

Translation for KR 101882745 B1 (Year: 2021).*
(Continued)

*Primary Examiner* — Alyson M Merlino
(74) *Attorney, Agent, or Firm* — Vivacqua Crane

(57) ABSTRACT

A vehicle hood latching mechanism, having a latch member pivotally connected to a housing defining a striker channel. The latch member includes a primary catch portion between the intersection of a first lever arm and a second lever arm, a secondary catch portion on the first lever arm facing the primary catch portion, and a latch cam surface on the second lever arm proximal to the primary catch portion. The latch cam surface is configured such that a force applied onto the latch cam surface causes the latch member to pivot to a first position. A cancel lever is pivotally mounted to an end of the second lever arm of the latch member and includes an exterior cam surface configured such that a force applied onto the exterior cam surface induces a moment M onto the second lever arm causing the latch member to rotate into the first position.

17 Claims, 9 Drawing Sheets

(51) Int. Cl.

| | |
|---|---|
| ***E05B 85/26*** | (2014.01) |
| ***E05B 85/24*** | (2014.01) |
| ***E05B 81/14*** | (2014.01) |
| ***E05B 79/20*** | (2014.01) |

(56) References Cited

U.S. PATENT DOCUMENTS

| | | | | | |
|---|---|---|---|---|---|
| 4,875,724 | A | | 10/1989 | Gruber | |
| 5,348,355 | A | * | 9/1994 | Oyha | E05B 83/16 292/11 |
| 5,738,393 | A | * | 4/1998 | Chao | E05B 83/24 292/216 |
| 6,106,033 | A | * | 8/2000 | Ruckert | E05B 83/16 292/216 |
| 6,386,599 | B1 | | 5/2002 | Chevalier | |

OTHER PUBLICATIONS

U.S. Appl. No. 15/693,809, First Named Inventor: John Perring, "Latch Mechanism for a Vehicle," filed Sep. 1, 2017.
U.S. Appl. No. 15/871,568, First Named Inventor: James N. Nelsen, "Latch Mechanism for a Vehicle," filed Jan. 15, 2018.
U.S. Appl. No. 15/914,573, First Named Inventor: James N. Nelsen, "Dual-Pull Latch Assemblies for Compartment Closure Assemblies of Motor Vehicles," filed Mar. 7, 2018.
U.S. Appl. No. 16/105,079, First Named Inventor: James N. Nelsen, "Latch Mechanism," filed Aug. 20, 2018.

* cited by examiner

DUAL ACTUATED LATCH MECHANISM FOR A VEHICLE

INTRODUCTION

The disclosure relates to a hood latch mechanism for a motor vehicle, more particularly to a dual actuated hood latch mechanism having a remotely operated primary latching member and a secondary latching member.

In motor vehicles, a hood or bonnet is a moveable, typically hinged, panel that selectively covers and permits access to a compartment defined by the vehicle body. Vehicle hood latch systems typically include a striker on the hood, a primary latching member on the vehicle body engageable with the striker to hold the hood in the closed position, and a secondary latching member on the vehicle body in the path taken by the striker from the latched condition. The secondary latching member acts as a redundant safety device to prevent the hood from opening in the event that the primary latching member might not be properly latched or disengage during service.

For vehicle hood latches that use dual pull latches, both the primary latching member and the secondary latching member are typically cable-actuated from within the vehicle. The motorist is not required to leave the vehicle and insert his hand into a restricted space at the front edge of the hood in order to disengage the secondary latching member from the striker. Current dual pull hood latches have higher static latching effort and higher closing energy due to travel and force requirements to lift the hood consistently past the latch position. Additionally, in order to engage the secondary latching member from an open position, the hood must be pushed down with some force or closed with some velocity, unlike traditional hood latches that will engage the secondary latching member under their own weight if merely set down by the customer.

Thus, while dual pull latches achieve their intended purpose, there is a need for an improved dual pull latch mechanism that requires less static latching effort and lower closing energy as compared to current dual pull latches.

SUMMARY

According to several aspects, a vehicle having a hood latching mechanism is disclosed. The vehicle includes a vehicle body defining a compartment, a hood panel adjustably mounted to the vehicle body and configured to selectively cover and uncover the compartment, the hood panel includes a striker, and a latching mechanism releasably engaging the striker. The latching mechanism includes a housing secured to the vehicle body. The housing includes a first side, an opposing second side, and a housing cam surface extending between the first side and second side in a central region of the housing. The housing cam surface defines a striker channel extending along an A-axis. The latching mechanism also includes a latch member pivotally connected to the first side of the housing, the latch member includes a first lever arm, a second lever arm extending from the first lever arm at an acute angle, and a latch side surface extending through the first lever arm and the second lever arm. The latch side surface defines a primary catch portion adjacent the striker channel between the intersection of the first lever arm and the second lever arm, a secondary catch portion on the first lever arm facing the primary catch portion, and a latch cam surface on the second lever arm proximal to the primary catch portion. The latch member is selectively pivotable between a first position, where the primary catch portion and the second catch portion are aligned with the striker channel along the A-axis, and a second position, where the primary catch portion and the second catch portion are not aligned with the striker channel along the A-axis. The latch cam surface is configured such that a force applied along the A-axis onto the latch cam surface, when the latch member is in the second position, causes the latch member to pivot to the first position.

In an additional aspect of the present disclosure, the latching mechanism further includes a first biasing member operating bi-directionally and applying a force to selectively preload the latch member to selectively rotate in opposing directions.

In another aspect of the present disclosure, the latching mechanism further includes a cancel lever pivotally mounted to an end of the second lever arm of the latch member spaced apart from the primary catch portion of the latch member, wherein the cancel lever includes a tab extending from the cancel lever; and a second biasing member urging the cancel lever to pivotally rotate in a first rotational direction causing the tab to engage the second lever arm thus limiting the rotation of the cancel lever in the first rotational direction.

In another aspect of the present disclosure, the cancel lever further includes an exterior cam surface configured such that a force applied along the A-axis onto the exterior cam surface, when the latch member is in the second position, induces a moment M onto the second lever arm causing the latch member to rotate into the first position.

In another aspect of the present disclosure, the exterior cam surface of the cancel lever transitions through an apex to a first interior cam surface.

In another aspect of the present disclosure, the first interior cam surface transitions to a second interior cam surface such that the first interior cam surface faces in a direction away from the exterior cam surface and toward the second interior cam surface.

In another aspect of the present disclosure, the cancel lever is configured to rotate in the first rotational direction when the striker engages the second interior cam surface as the striker is moved toward the striker channel, thereby allowing the striker to engage the latch cam surface.

In another aspect of the present disclosure, the cancel lever is configured to rotate in a second rotational direction opposite the first rotational direction when the striker engages the first interior cam surface as the striker is moved apart from the striker channel, thereby disengaging the striker from the locking mechanism.

In another aspect of the present disclosure, the latching mechanism further includes a fork bolt adjustably connected to the second side of the housing and movable between a latched position wherein the fork bolt releasably secures the striker to fasten the hood panel to the vehicle body and a first actuated position wherein the striker is adjustable relative to the housing.

In another aspect of the present disclosure, the second biasing member includes sufficient biasing force to urge the first interior cam surface of the cancel lever against the striker in the first rotational direction, when the latching mechanism is in a second actuated position with the latch member is in the second position, thus requiring the hood may be lifted to overcome the biasing force of the second biasing member such that the cancel lever rotates in the second rotational direction.

According to several aspects, a latching mechanism to releasably engage a striker of a hood panel to a vehicle body is closed. The latching mechanism includes a housing securable to the vehicle body, the housing includes a first side, an opposing second side, and at least one cam surface formed in the housing; a latch member pivotally connected to the first side of the housing, the latch includes a first lever arm, a second lever arm extending from the first lever arm at an acute angle, and a latch side surface extending through the first lever arm and the second lever arm; a first biasing member operating bi-directionally and applying a force to selectively preload the latch member to selectively rotate in a first direction and in a second direction opposite the first direction; a cancel lever pivotally mounted to an end of the second lever arm of the latch member, wherein the cancel lever includes an extending tab; a second biasing member urging the cancel lever to rotate in a first rotational direction causing the tab to engage the second lever arm thus limiting a rotation of the cancel lever in the first rotational direction; a fork bolt adjustably connected to the second side of the housing and movable between a fully latched position, wherein the fork bolt secures the striker to fasten the hood panel to the vehicle body, and a first actuated position, wherein the striker is released from the fork bolt; and a third biasing member biasing the fork bolt to rotate from the fully latched position to the first actuated position.

In an additional aspect of the present disclosure, the housing cam surface defines a striker channel extending along an A-axis, wherein the striker channel is configured to receive and guide the striker; and the cancel lever includes an exterior cam surface configured such that a force applied along the A-axis onto the exterior cam surface, when the latch member is in the second position, induces a moment M onto the second lever arm causing the latch member to rotate into a first position.

In another aspect of the present disclosure, the latch side surface defines a primary catch portion adjacent the striker channel between the intersection of the first lever arm and the second lever arm, a secondary catch portion on the first lever arm facing the primary catch portion, and a latch cam surface on the second lever arm proximal to the primary catch portion.

In another aspect of the present disclosure, the latch member is selectively rotatable between the first position, where the primary catch portion and the second catch portion are aligned with the striker channel along the A-axis, and a second position, where the primary catch portion and the second catch portion are not aligned with the striker channel along the A-axis. The latch cam surface is configured such that a force applied along the A-axis onto the latch cam surface, when the latch member is in the second position, causes the latch member to rotate to the first position.

In another aspect of the present disclosure, the exterior cam surface of the cancel lever transitions through an apex to a first interior cam surface, and the first interior cam surface transitions to a second interior cam surface such that the first interior cam surface faces in a direction away from the exterior cam surface and toward the second interior cam surface.

In another aspect of the present disclosure, the latching mechanism of claim 15 further includes a device disposed on the housing and configured to adjust the fork bolt from the locked position to the unlocked position; and an actuator cooperating with the device including a projection to engage the latch member and adjust the latch member from the first position to the second position.

According to several aspects, a latching mechanism to releasably engage a striker of a hood panel to a vehicle body is disclosed. The latching mechanism includes a housing secured to the vehicle body, wherein the housing includes a first side, an opposing second side, and a housing cam surface extending between the first side and second side in a central region of the housing, wherein the housing cam surface defines a striker channel extending along an A-axis configured to receive and guide the striker; a fork bolt adjustably connected to the second side of the housing and movable between a locked position wherein the fork bolt releasably secures the striker to fasten the hood panel to the vehicle body and an unlocked position wherein the striker is adjustable relative to the housing; a device disposed on the housing and configured to adjust the fork bolt from the locked position to the unlocked position; a latch member pivotally connected to the first side of the housing, the latch member includes a first lever arm, a second lever arm extending from the first lever arm at an acute angle, and a latch side surface extending through the first lever arm and the second lever arm, wherein the latch side surface defines a primary catch portion adjacent the striker channel between the intersection of the first lever arm and the second lever arm, a secondary catch portion on the first lever arm facing the primary catch portion, and a latch cam surface on the second lever arm proximal to the primary catch portion, and wherein the latch member is selectively rotatable between a first position, where the primary catch portion and the second catch portion are aligned with the striker channel along the A-axis, and a second position, where the primary catch portion and the second catch portion are not aligned with the striker channel along the A-axis; and an actuator cooperating with the device including a projection to engage the latch and adjust the latch from the first unlatched position to the second unlatched position.

In an additional aspect of the present disclosure, the latching mechanism further includes a cancel lever pivotally mounted to an end of the second lever arm of the latch member spaced apart from the primary catch portion of the latch member, wherein the cancel lever includes a tab extending from the cancel lever; and a second biasing member urging the cancel lever to rotate in a first rotational direction causing the tab to engage the second lever arm thus limiting the rotation of the cancel lever.

In another aspect of the present disclosure, the cancel lever further includes an exterior cam surface configured such that a force applied along the A-axis onto the exterior cam surface, when the latch member is in the second position, induces a moment M onto the second lever arm causing the latch member to rotate into the first position.

In another aspect of the present disclosure, the cancel lever is rotatable in a second rotational direction opposite the first rotational direction when a sufficient force is applied to the first interior surface to overcome the basing force of the second biasing member.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
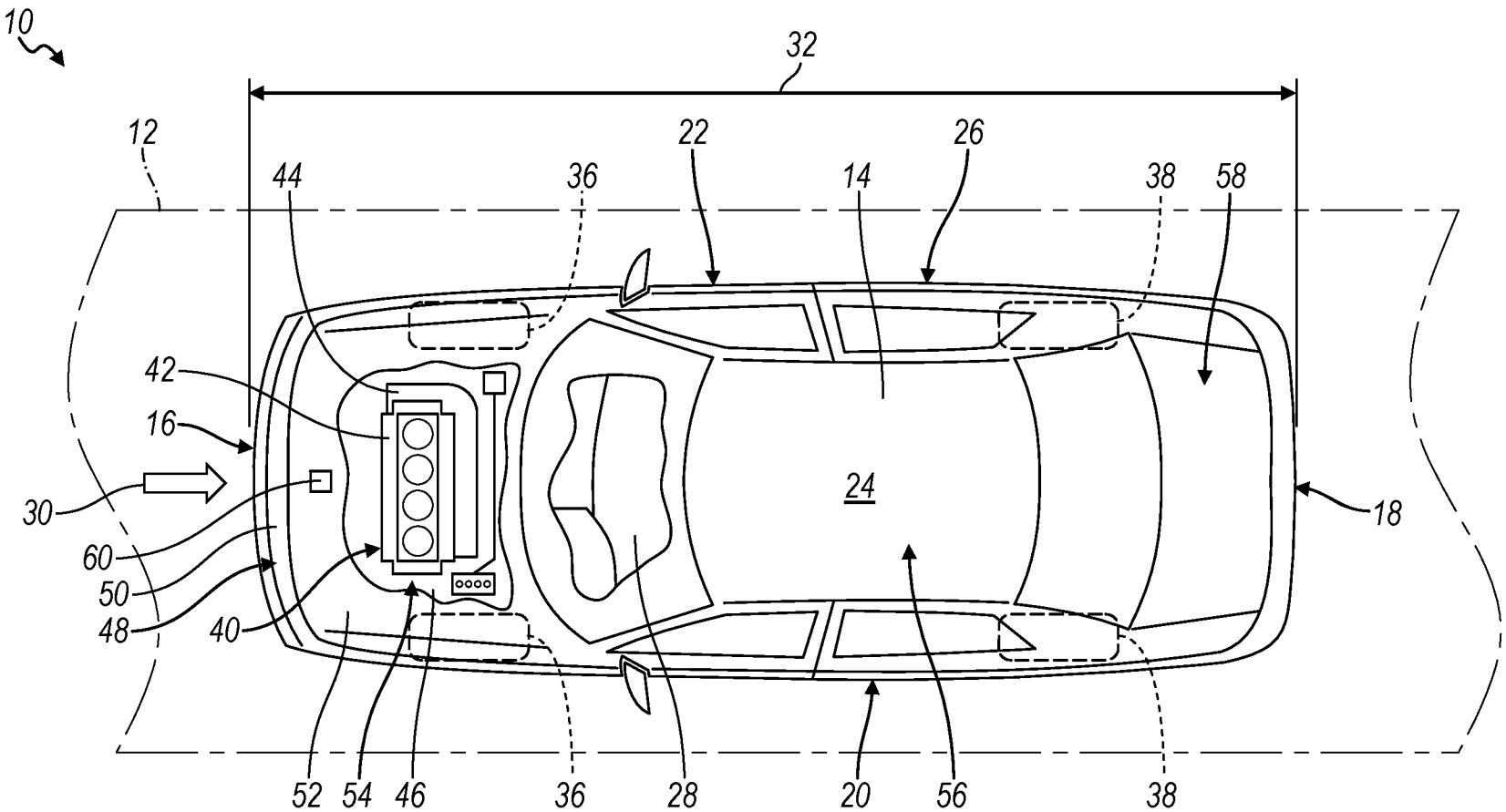
FIG. 1 is a schematic top view of a vehicle showing a partially sectioned hood panel and an under-hood compartment covered thereby, according to the disclosure.

Referring to the drawings, wherein like reference numbers correspond to like or similar components throughout the several Figures, an example vehicle 10 is shown schematically in FIG. 1. The vehicle 10 may include, but not be limited to, a commercial vehicle, industrial vehicle, passenger vehicle, aircraft, watercraft, train or any mobile platform. It is also contemplated that the vehicle 10 may be any mobile platform, such as an airplane, all-terrain vehicle (ATV), boat, personal movement apparatus, robot and the like to accomplish the purposes of this disclosure. For purposes of convenience and clarity, directional terms such as top, bottom, left, right, up, over, above, below, beneath, rear, and front, may be used with respect to the drawings. These and similar directional terms are not to be construed to limit the scope of the disclosure.

The vehicle 10 in FIG. 1 is positioned relative to a road surface 12. The vehicle 10 includes a first end or front end 16, an opposing second end or rear end 18, a first lateral portion or left side 20 generally extending between the first and second ends 16, 18, and an opposing second lateral portion or right side 22. The vehicle body 14 further includes a top body portion 24, which may include at least a vehicle roof portion, and an opposing lower body portion or underbody 26. A passenger compartment 28 is defined in the vehicle body 14. As understood by those skilled in the art, the first or front end 16 may face oncoming ambient airflow 30 when the vehicle 10 is in motion relative to the road surface 12. Each of the left side, right side, top, and underbody body sections, 20, 22, 24, and 26, respectively, spans a distance 32 between the front and rear ends 16, 18 of the body 14.

The vehicle 10 includes one or more wheels 36, 38 arranged between the first and second vehicle body ends 16, 18, proximate the left and right sides 20, 22. The one or more wheels includes a first set of wheels 36 disposed proximate the first or front end 16 of the vehicle 10 and a second set of one or more wheels 38 disposed proximate the second or rear end 18 of the vehicle 10. As shown in FIG. 1, the first set of one or more wheels 36 includes a pair of front wheels that are rotatably connected to the vehicle 10 and rotate about an axis while the second set of one or more wheels 38 includes a pair of rear wheels that are rotatably connected to the vehicle 10 and rotate about an axis.

The vehicle body 14 defines a compartment 46 for housing a powertrain 40. The powertrain 40 that may include an internal combustion engine 42 for generating engine torque and a transmission 44 operatively connecting the engine 42 to at least some of the road wheels 36, 38 for transmitting engine torque thereto. For an electric or hybrid vehicle, the powertrain 40 may include one or more motor-generators, none of which are shown, but the existence of which can be appreciated by those skilled in the art. However, it is understood that the compartment 46 may be configured as a storage compartment or other vehicle space if the powertrain 40 of the vehicle 10 is positioned in a central or rear portion of the vehicle 10.

As shown, the vehicle body 14 also includes a vehicle fascia 48 arranged at the front end 16. The fascia 48 defines at least one opening 50 receiving at least some of the oncoming ambient airflow 30, which may be used for cooling the powertrain 40. Generally, the at least one opening 50 that is provided in the front end 16 of the vehicle 10, such as the grille openings 50, as well as various protruding features on the surface of the vehicle body 14, tend to impact the vehicle's 10 aerodynamic signature. Although one grille opening 50 is depicted and described, nothing precludes the vehicle 10 from having a greater number of grille openings for admitting the ambient airflow 30 into the compartment 46 from the ambient atmosphere.

The vehicle 10 also includes a hood panel or bonnet 52 adjustably mounted to the vehicle body 14 and movable between at least one open position where the hood panel 52 is unfastened from the vehicle body 14 to provide access to the compartment 46 and a closed position wherein the hood panel 52 extends at least partially above and across to cover the compartment 46 to restrict access to the compartment 46. The hood panel 52 may be pivotally mounted to one or more load-bearing body frame members of the body 14 of the vehicle 10 to provide access to and securely close the top portion of the compartment 46. The vehicle 10 may also include a vehicle roof, generally represented by numeral 56, and a trunk lid 58. Corresponding to the specifically shown front-engine configuration of the vehicle 10, the hood panel 52 is depicted as arranged generally proximate the front end 16, while the trunk lid 58 is arranged generally proximate the rear end 18 of the vehicle body 14 of the vehicle 10.

The vehicle 10 is equipped with a latch and lock system that employs a concealed hood latch or latching mechanism 100 movable between a latched position to secure the hood panel 52 in a closed position relative to the vehicle body 14, as shown in FIG. 1 and at least one unlatched or actuated position. It is contemplated that the latching mechanism 100 is mounted to the front or forward portion of the vehicle 10 with a hood panel 52 that opens from the forward portion of the vehicle 10. The latching mechanism 100 cooperates with the hood panel 52 to secure the hood panel 52 proximate to the compartment 46 in the vehicle body 14. Further, it is contemplated that the latching mechanism 100 of the present disclosure may be configured for use without an external handle or member cooperating with the latching mechanism 100 to releasably secure the hood panel 52 to the latching mechanism 100 and thereby, the hood panel 52 to the vehicle 10.

Referring to the FIGS. 2A-2B through 8A-8B, while the latching mechanism 100 is illustrated in one non-limiting configuration, it is understood that the latching mechanism 100 may be installed in a variety of positions and arrangements depending upon the configuration of the vehicle 10. For example, the front or forward view may be reversed with the rear or rearward views such that the latching mechanism 100 may be mounted to either the front or the rear of a tie bar structure. Further, the latching mechanism 100 may be configured for use in right hand drive and left-hand drive vehicle configurations in order to dictate the cable going to the driver's side of the vehicle. Additionally, the latching mechanism 100 may use different part configurations than as illustrated.

Figure 2A:
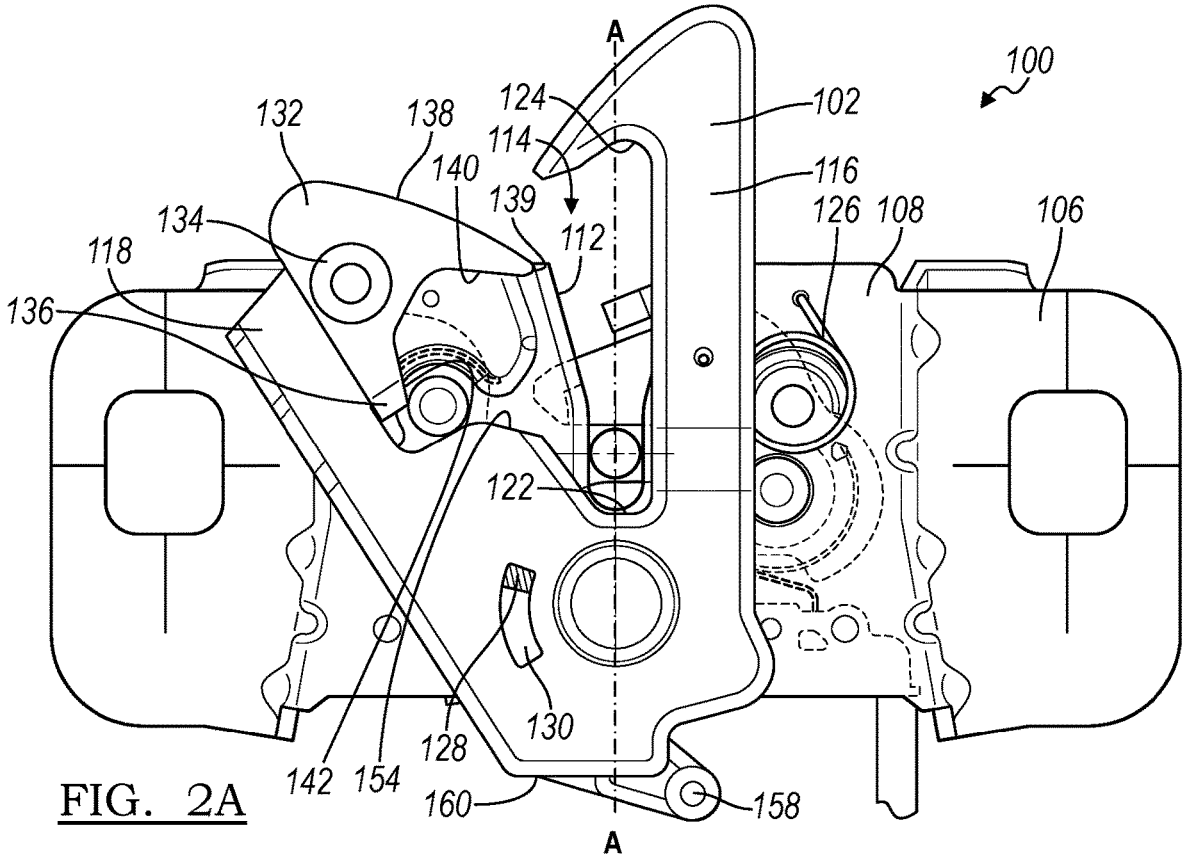
FIGS. 2A-2B are schematic front and rear views of a latching mechanism in a fully latched position.
Figure 2B:
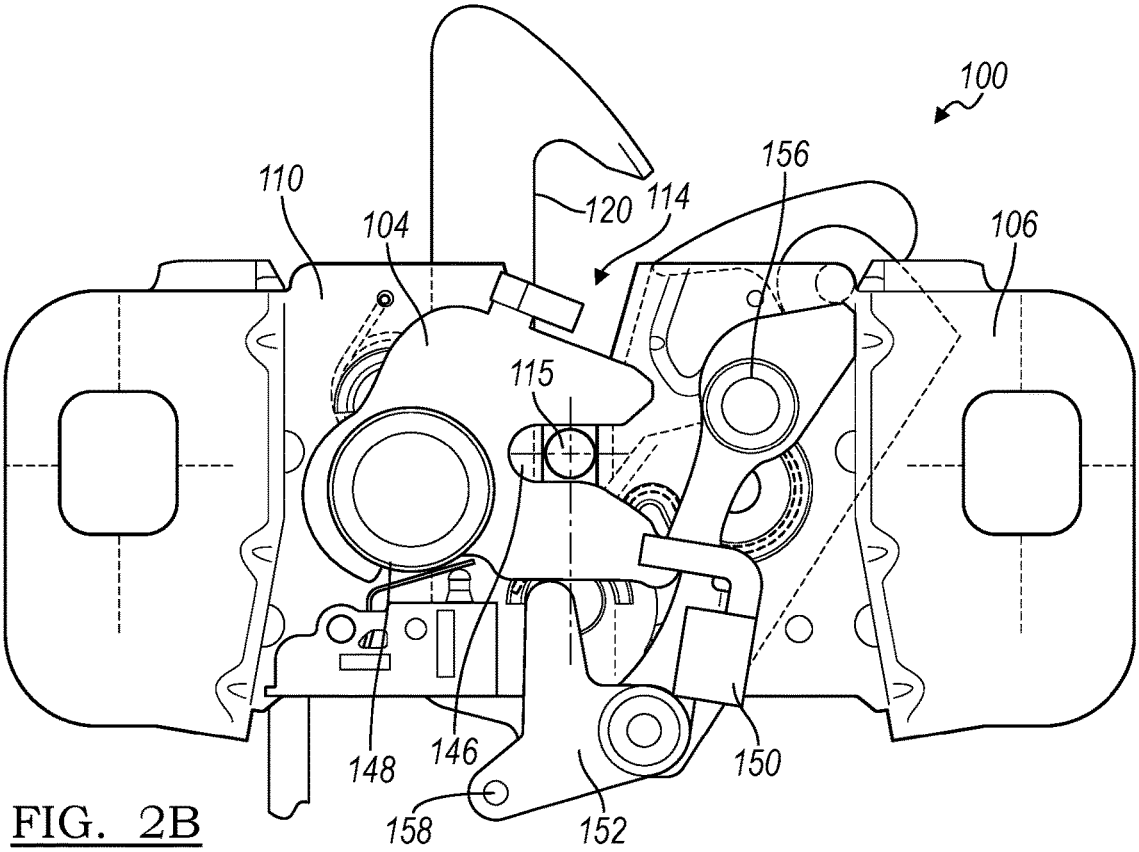

Referring to FIG. 2A-2B, the latching mechanism 100 includes a latch member 102 and a fork bolt 104, both of which are pivotally connected to a housing 106 via a fastener, such as a rivet or the likes. The housing 106 is in turn mounted to a portion of the vehicle body 14. The housing 106 includes a first side 108 and an opposing second side 110. The first side 108 of the housing 106 receives the latch member 102 pivotally connected thereto and the second side 110 receives the fork bolt 104 pivotally connected thereto. The housing 106 further includes a housing cam surface 112 extending between the first side 108 and second side 110 in a central region of the housing 106 defining a striker channel 114 extending along an A-axis. The striker channel 114 is configured to receive and guide a striker 115 therethrough.

The latch member 102 includes a first lever arm 116, a second lever arm 118 extending from the first lever arm 116 at an acute angle, and a latch side surface 120 extending through the first lever arm 116 and the second lever arm 118. The latch side surface 120 defines a primary catch portion 122 between the intersection of the first lever arm 116 and the second lever arm 118, and a secondary catch portion 124 on the first lever arm 116 facing the primary catch portion 122. The primary catch portion 122 is defined adjacent the striker channel 114 in the central region of the housing 106. The secondary catch portion 124 is defined above an upper portion of the housing 106. The latch side surface 120 further defines a latch cam surface 154 on the second lever arm 118 proximal to the primary catch portion 122. The latch cam surface 154 is configured such that a force applied along the A-axis onto the latch cam surface 154 causes the latch member 102 to rotate such that the primary catch portion 122 and the second catch portion are aligned with the striker channel 114 along the A-axis.

The latching mechanism 100 may include a first biasing member 126 such as an over-center spring 126 or the like, operating bi-directionally and applying a force to selectively preload the latch member 102 to selectively rotate in opposing directions. The first biasing member may also be that of torsional toggle spring, a pin acting on a bent leaf spring that compresses against the pin going over a hump in the middle, and/or other extension/compression springs that have a similar over-center characteristic. The first biasing member 126 may be configured such that, depending on the position of the latch member 102, the force of the first biasing member 126 may be applied in one direction, or another, opposite direction. For example, as shown in FIG. 2A the force of the first biasing member 126 is applied in a first direction, a counter-clockwise direction, to maintain the primary catch portion 122 in a latched position to facilitate closure of the under-hood compartment 54 via the hood panel 52. Also, for example, in FIG. 6A, the force of the first biasing member 126 is applied in a second direction, shown as a clockwise direction, to maintain the primary catch portion 122 in an unlatched position spaced apart from the path of travel of the striker 115.

Referring back to FIG. 2, the latching mechanism 100 may also include a limiter 128 configured to travel in a slot 130 defining a range of motion for the latch member 102. The limiter 128 may cooperate with and extend from the housing 106 or may be a distinct component of the latching mechanism 100. The slot 130 may be formed in a portion of the latching mechanism 100 and may be formed in a variety of geometries and positions. In one non-limiting example, slot 130 may be arcuate in shape configured to define a predetermined angle of rotation for the latch member 102 relative to a pivot center. The slot 130 may be sized to allow the limiter 128 to travel therein and thereby, limit the range of motion of the limiter 128 within the geometry defining the slot 130.

Figure 6A:
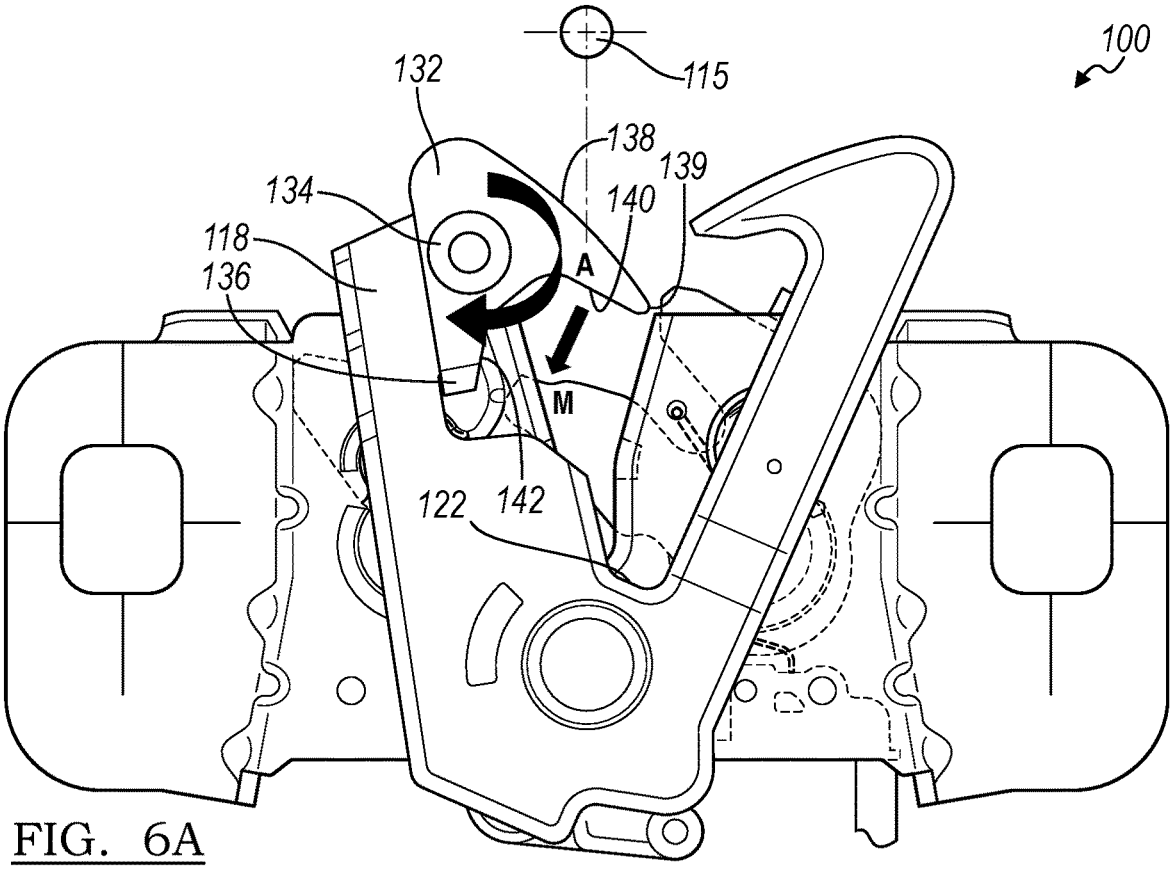
FIGS. 6A-6B are schematic front and rear views of the latching mechanism in the fully unlatched position.
Figure 7A:
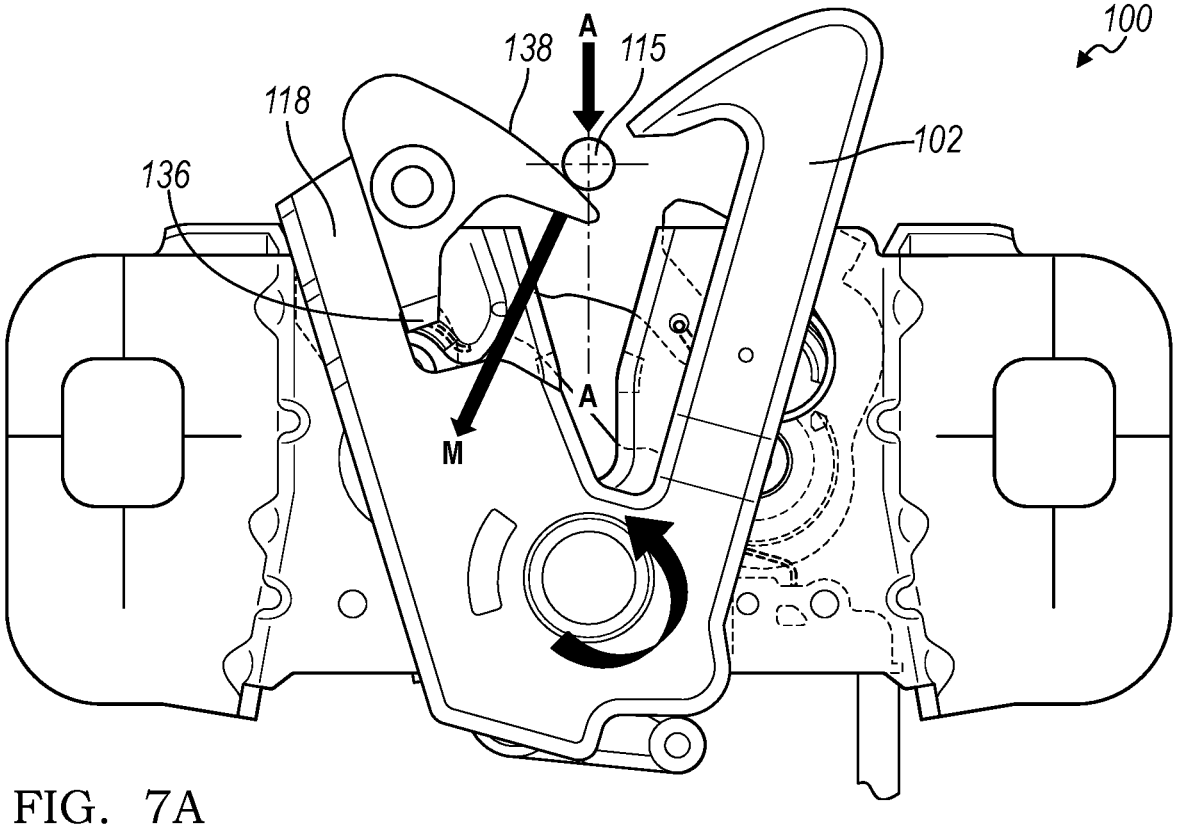
FIGS. 7A-7B are schematic front and rear views of the latching mechanism transitioning from the fully unlatched position to the first actuated position.

The latching mechanism 100 further includes a cancel lever 132 pivotally mounted to an end of the second lever arm 118 spaced apart from the primary catch portion 122. The cancel lever 132 includes a second biasing member 134, such as a spring, urging the cancel lever 132 to rotate in a first direction, shown as a clockwise direction in FIG. 6A, causing a tab 136 extending from the cancel lever 132 to engage the second lever arm 118 thus limiting the rotation of the cancel lever 132. The cancel lever 132 further includes an exterior cam surface 138 transitioning through an apex 139 to a first interior cam surface 140, which transitions to a second interior cam surface 142. The first interior cam surface 140 faces in a direction away from the exterior cam surface 138 and toward the second interior cam surface 142. Referring to FIGS. 6A and 7A, the exterior cam surface 138 is configured such that a force applied along the A-axis onto the exterior cam surface 138 induces a moment M onto the second lever arm 118 causing the latch member 102 to rotate in a second direction, counter-clockwise.

Referring now to FIG. 2B, the fork bolt 104 defines a fork bolt channel 146 configured to receive and secure the striker 115 in the latched position to fasten the hood panel 52 to the vehicle body 14. The fork bolt 104 is positioned on the housing 106 such that the fork bolt 104 and fork bolt channel 146 of the fork bolt 104 are disposed proximate striker channel 114. In one non-limiting embodiment, the fork bolt 104 is pivotally connected to the second side 110 of the housing 106 on the opposing surface from the latch member 102 and is movable between a locked position wherein the fork bolt channel 146 in the fork bolt 104 secures the striker 115 to fasten the hood panel 52 to the vehicle body 14 in the latched position and an unlocked position allowing the striker 115 to be released from the fork bolt channel 146. The fork bolt 104 is configured to cooperate with an actuator 152 to selectively releasing the striker 115 from the fork bolt channel 146.

The latching mechanism 100 may additionally include a third biasing member 148 or element, shown in FIG. 2B, which may be a clock spring or the like, operatively connected to the fork bolt 104 to allow the fork bolt 104 to selectively rotate relative to the housing 106. The third biasing member 148 may apply a preload force directed to bias the fork bolt 104 to rotate from a locked position to an unlocked position where the fork bolt 104 releases the striker 115 and permits the hood panel 52 to move away from the vehicle body 14 in response to a first actuation of a device 150. The fork bolt 104 along with the third biasing member 148 may be operatively connected to the housing 106 via a suitable fastener, such as a rivet or the like.

The device 150 is pivotally connected to the second side of the housing 106 and configured to releasably engage the fork bolt 104. For example, the device 150 may be actuated by a cable, lever with a catch, and/or a solenoid actuated by the operator of the vehicle 10. The release of the fork bolt 104 frees the hood panel 52 to separate from the vehicle body 14 at least a predetermined distance and thereby establish an opening between the vehicle body 14 and the hood panel 52. The device 150 may be actuated remotely from the vehicle's passenger compartment 28 or by a remote activation device (not shown) to operatively release the fork bolt 104 to allow the striker 115 to be moved from the fork bolt channel 146 of the fork bolt 104. A fourth biasing member 156 may be provided to cooperate with the device 150. The fourth biasing member 156 may be a spring or the like that may apply a force to at least a portion of the device 150 to release the fork bolt 104 from the latched position to the disengaged position in response to actuation of the device 150. The fourth biasing member 156 may be operatively connected to the housing 106 via a suitable fastener.

In a mechanical system architecture, pulling on the hood latch release mechanism such as a release lever that cooperates with the device 150 will apply a tensile force to a hood latch release cable (not shown), such as a Bowden-type cable. The device 150 activates actuates the latching mechanism 100 to unlatch the striker 115 thereby allowing the hood panel 52 to be moved to an open position. Other mounting and latching architectures, including mechanical, electrical, and electro-mechanical configurations, are envisioned as being within the scope of this disclosure. For instance, the release cable may be representative of an electrical wire harness or fiber optic cable in applications where the hood latching mechanism 100 is embodied as a power hood latch.

Figure 3A:
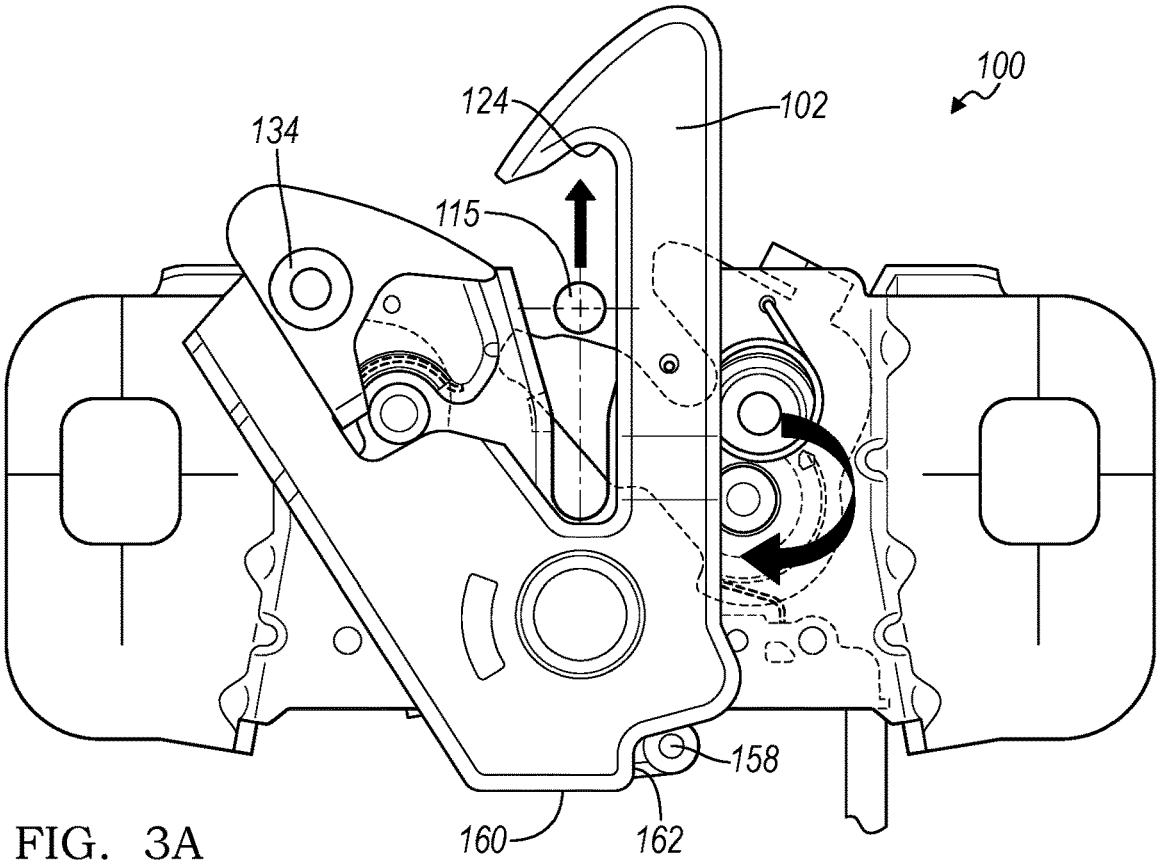
FIGS. 3A-3B are schematic front and rear views of the latching mechanism in a first actuated position.
Figure 3B:
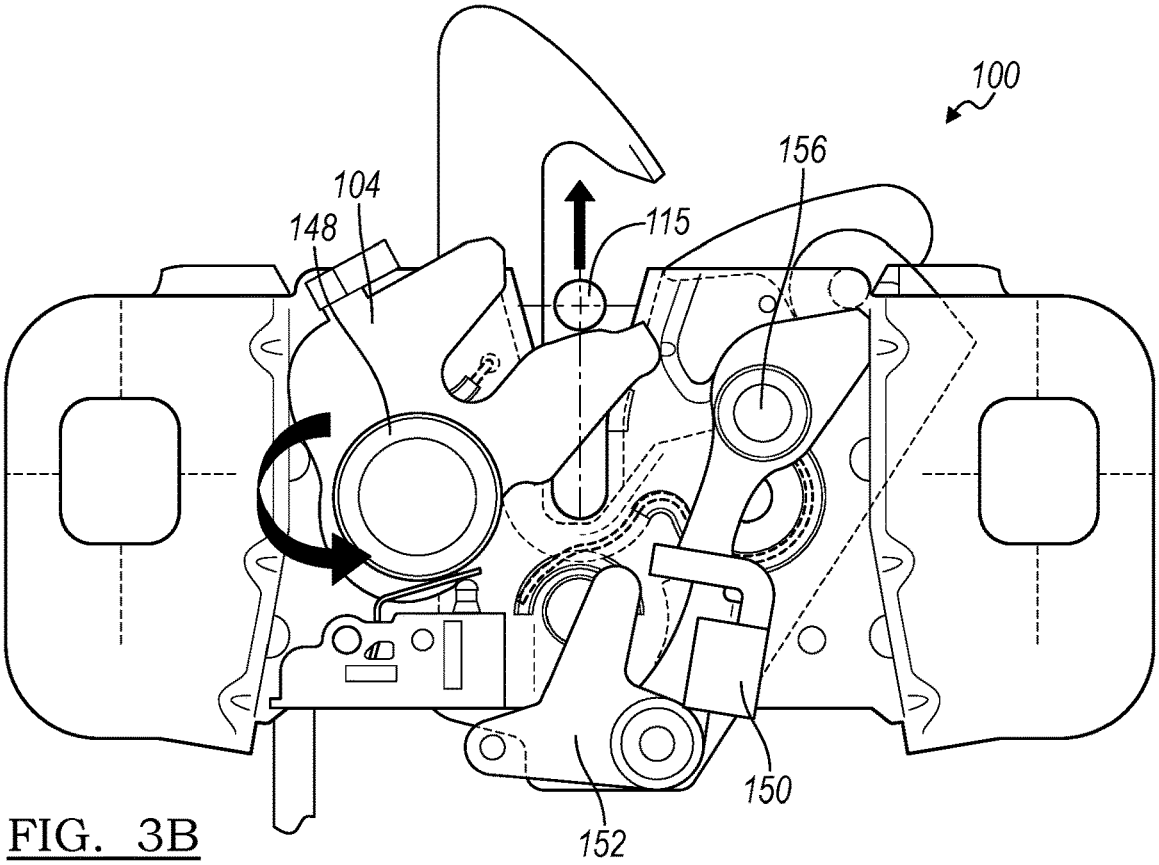
Figure 4A:
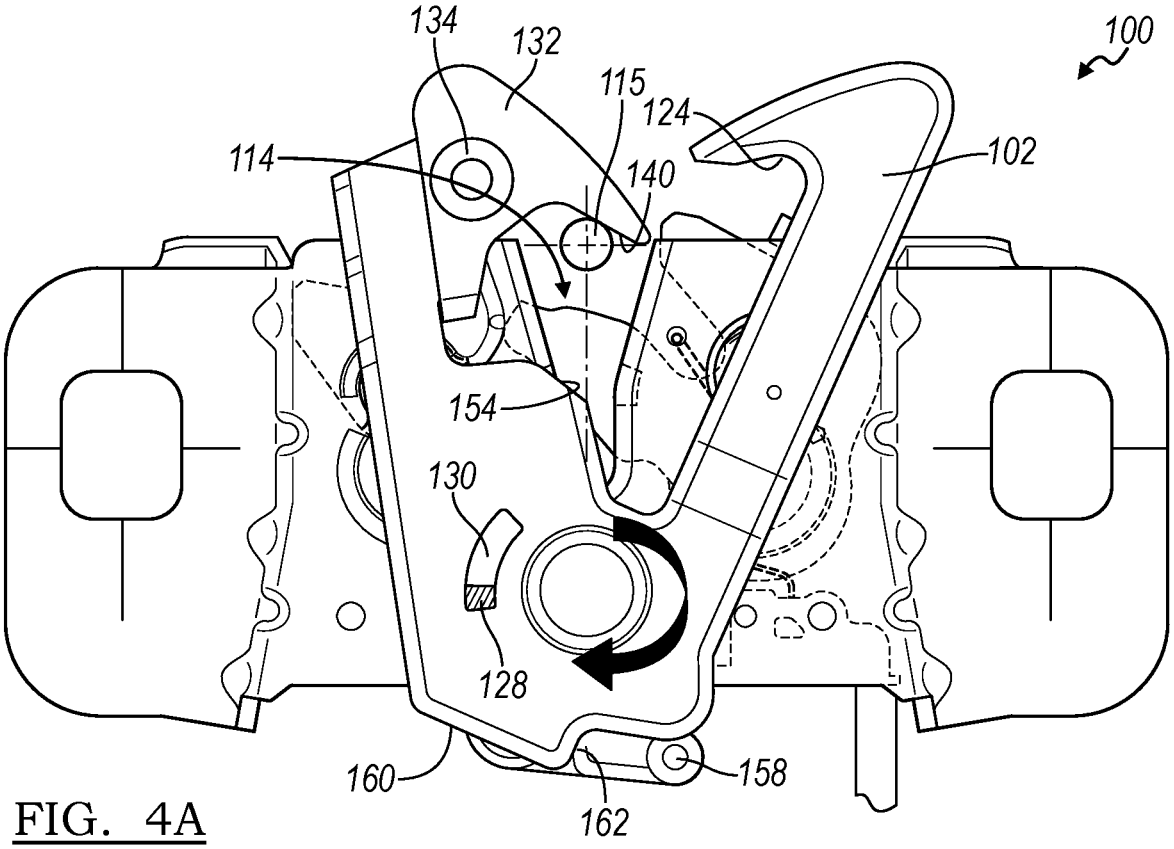
FIGS. 4A-4B are schematic front and rear views of the latching mechanism in a second actuated position.
Figure 4B:
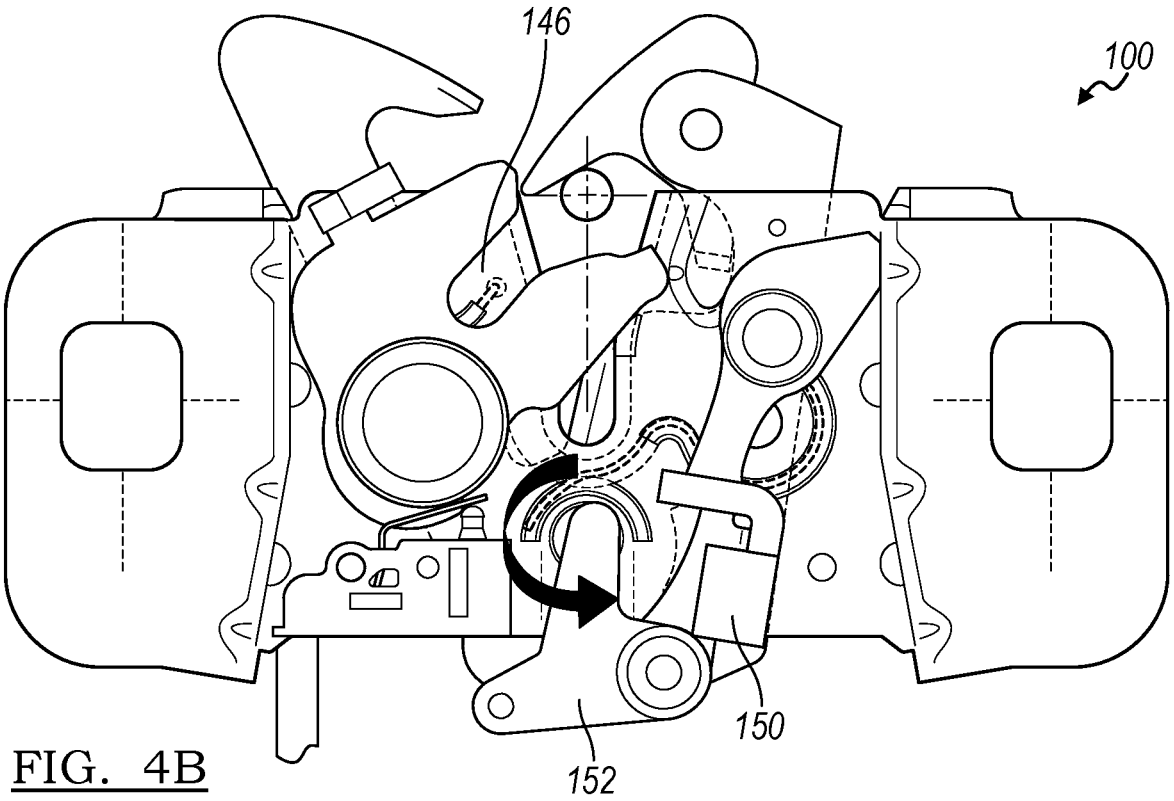
Figure 5A:
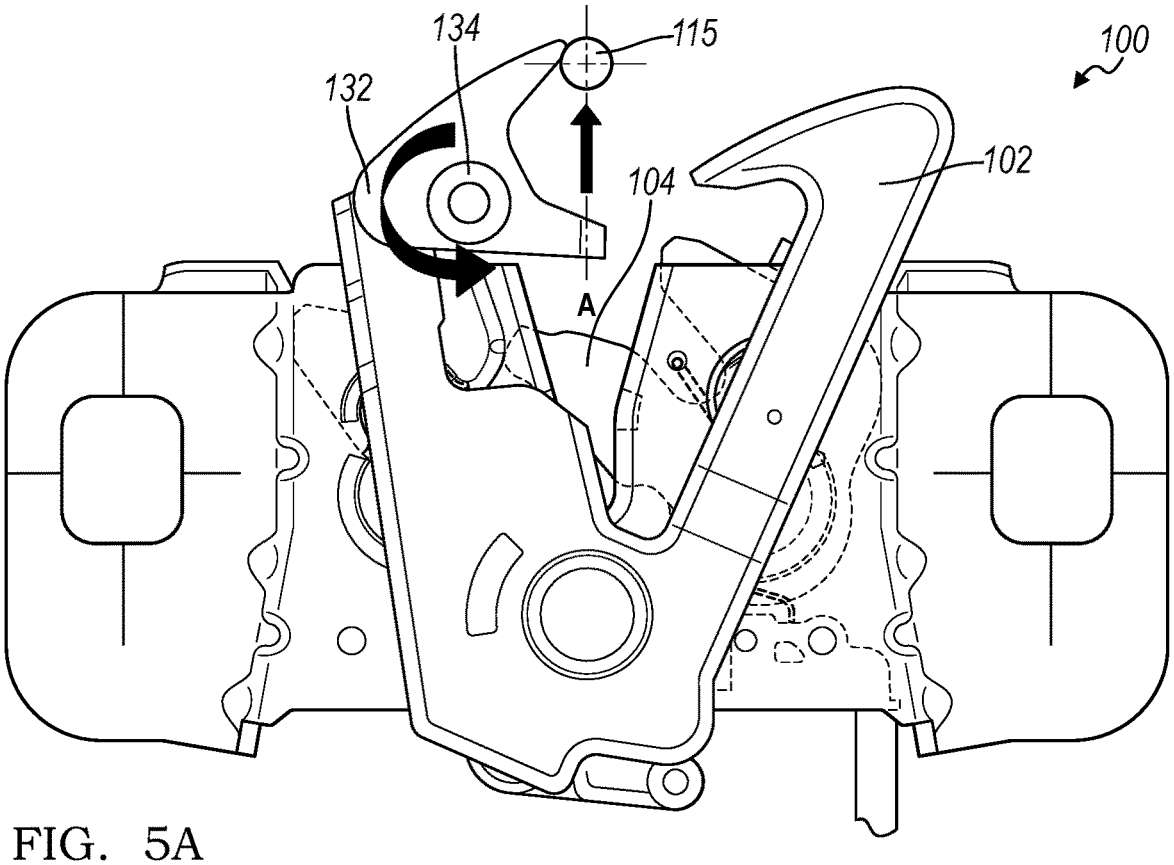
FIG. 5A-5B are schematic front and rear views of the latching mechanism transitioning from the second actuated position to the fully unlatched position.
Figure 5B:
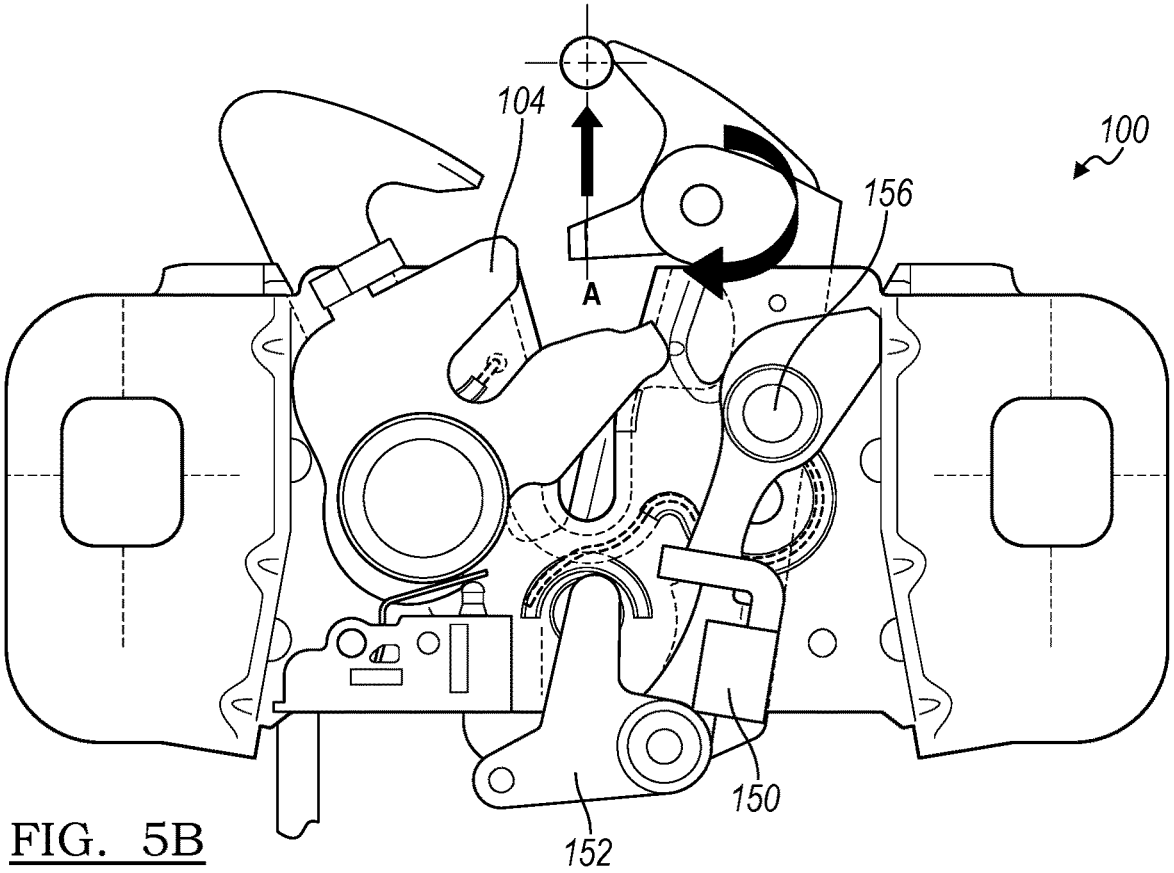

In a dual actuated system, the first actuation places the latching mechanism 100 in a first actuated position as shown in FIGS. 3A-3B. In the first actuated position, the striker 115 is released from the fork bolt 104 and cooperates with the latch member 102 to maintain the hood panel at least a predetermined distance from the vehicle body. A second pull of the release cable places the latching mechanism 100 in a second actuated position where the secondary catch portion 124 of the latch member 102 pivots away from the A-axis as shown in FIGS. 4A-4B and the first interior cam surface 140 of cancel lever 132 pivots toward the A-axis. The striker 115 is held in position by the second biasing member 134 urging the interior cam surface 140 of the cancel lever 132 against the striker 115. In the second actuated position, the hood may be manually lifted to overcome the biasing force of the second biasing member 134 such that the cancel lever 132 rotates out of the way as shown in FIGS. 5A-5B.

FIGS. 2A-2B illustrate the latching mechanism 100 in a fully latched position. In the fully latched position, the primary catch portion 122 of the latch member 102 is configured to cooperates with the fort bolt 104 to facilitate or maintain closure of the under-hood compartment 54 via a striker 115 cooperating with the hood panel 52 such that the panel 52 is being positioned adjacent or against the vehicle body 14. The actuator 152 cooperates with and extends from a portion of the device 150 to engage the latch member 102. The actuator 152 may be operatively connected to a portion of the device 150 by a fourth biasing member or element, generally referenced by numeral 156, which may include a clock spring or the like. The fourth biasing member 156 is configured to apply a preload force directed to shift the actuator 152 to a position where the actuator 152 engages a portion of the latch member 102 as will be described in greater detail below.

Best shown in FIG. 2B, the actuator 152 is positioned proximate the latch member 102. The actuator 152 is disposed on one side of the housing 106 while the latch member 102 is disposed on an opposing side of the housing 106. The actuator 152 includes a projection 158 extending integrally from a surface of the actuator 152. The projection 158 is configured to engage a lower surface 160 of the latch member 102 as shown FIG. 2A.

From the fully latch position shown in FIGS. 2A-2B, the device 150 may be actuated by a pull cable or other manners to release the fork bolt 104 from engagement with the device 150. The device 150 may selectively rotate about the fourth biasing member 156 between an engaged position and a disengaged position. Referring to FIG. 3B, the third biasing member 148 applies a force to shift or selectively rotate the fork bolt 104 in a counterclockwise manner from the locked position to an unlocked position where the fork bolt 104 releases the striker 115 when the device 150 releases the fork bolt 104. Actuation of the fork bolt 104 by the device 150 allows the striker 115 to be moved from the fork bolt 104 and adjusted from the latched position to the first actuated position. Referring to FIG. 3A, in response to movement of the device 150, the actuator 152 adjusts or selectively rotates about the fourth biasing member 156 such that the projection 158 on actuator 152 is disposed proximate the lower surface 160 of the latch member 102. It is contemplated that the projection 158 may engage the lower surface 160 of the latch member 102 when the device 150 is rotated to disengage the fork bolt 104.

Referring now to both FIGS. 3A-3B, the latching mechanism 100 is shown in a first actuated position, also known as the first unlatched position. The latch member 102 is configured such that the secondary catch portion 124 extends generally above a central region of the latching mechanism 100 to releasably engage and receive the striker 115 in the secondary catch portion 124 as the striker 115 moves to the full travel position of the second catch portion 124. The secondary catch portion 124 may also provide physical feedback to the device 150 and related components to indicate completion of the second position movement. In response to positioning of the striker 115 in the secondary catch portion 124, the device 150 is repositioned to the first or latched position. As the device 150 is repositioned, the actuator 152 translates such that the projection 158 of actuator 152 is placed in a portion 162 of the lower surface 160 of the latch member 102

Referring now to FIGS. 4A-4B, the latching mechanism 100 is shown in a second actuated position or second unlatched position. In the transition from the first unlatched position, as shown in FIGS. 3A-3B, to the second unlatched position, as shown in FIGS. 4A-4B, the actuator 152 cooperating with device 150 is adjusted such that projection 158 engages the portion 162 of the lower surface 160 of the latch member 102 when the device 150 is actuated, thereby translating or rotating the latch member 102 from the first unlatched position to the second unlatched position. In response to second actuation of the device 150, the latch member 102 is selectively rotated or translated relative to the housing 106 such that the secondary catch portion 124 is translated away from a position adjacent the central region of the latching mechanism 100.

The limiter 128 may be configured to travel in the slot 130 of latch member 102 is adjusted between a first position to a second position. The second position of the slot 130 defines the predetermined angle of rotation for the latch member 102 relative to a pivot center and thereby, limits the range of motion of the limiter 128 within the geometry defining the slot 130 such that the first interior cam surface 140 obstructs the striker channel 114 to engage the striker 115. As the latch member 102 is rotated into the latch member second position, the interior cam surface 140 of the cancel lever 132 overlaps the striker channel 114 as the secondary catch portion 124 of the latch member is rotate away from the striker channel 114. In other words, when the striker 115 is fully released from the fork bolt 104 and travels at least partially through the housing 106 proximate the striker channel 114 toward the cancel lever. The striker 115 engages the lower portion or surface 140 of the cancel lever 132 positioned between the primary catch portion 122 and secondary catch portion 124. The cancel lever 132 stops the travel of the striker 115 and position the striker 115 in the second unlatched position without the use of or support by the secondary catch portion 124 of the latch member 102.

The latching mechanism 100 in the second actuated position, as shown in FIG. 4A-4B may be repositioned back in the fully latched position, as shown in FIGS. 2A-2B, without the need to first fully releasing the striker from the latching mechanism 100 from the second actuated position. This can be accomplished by pushing the hood of the vehicle into the closed position, causing the striker 115 to travel along the striker channel 114 to engage the latch cam surface 154 and then into the fork bolt channel 146, thereby causing both the latch member 102 and fork bolt 104 to rotate back into the fully latch position as shown in FIGS. 2A-2B.

Figure 6B:
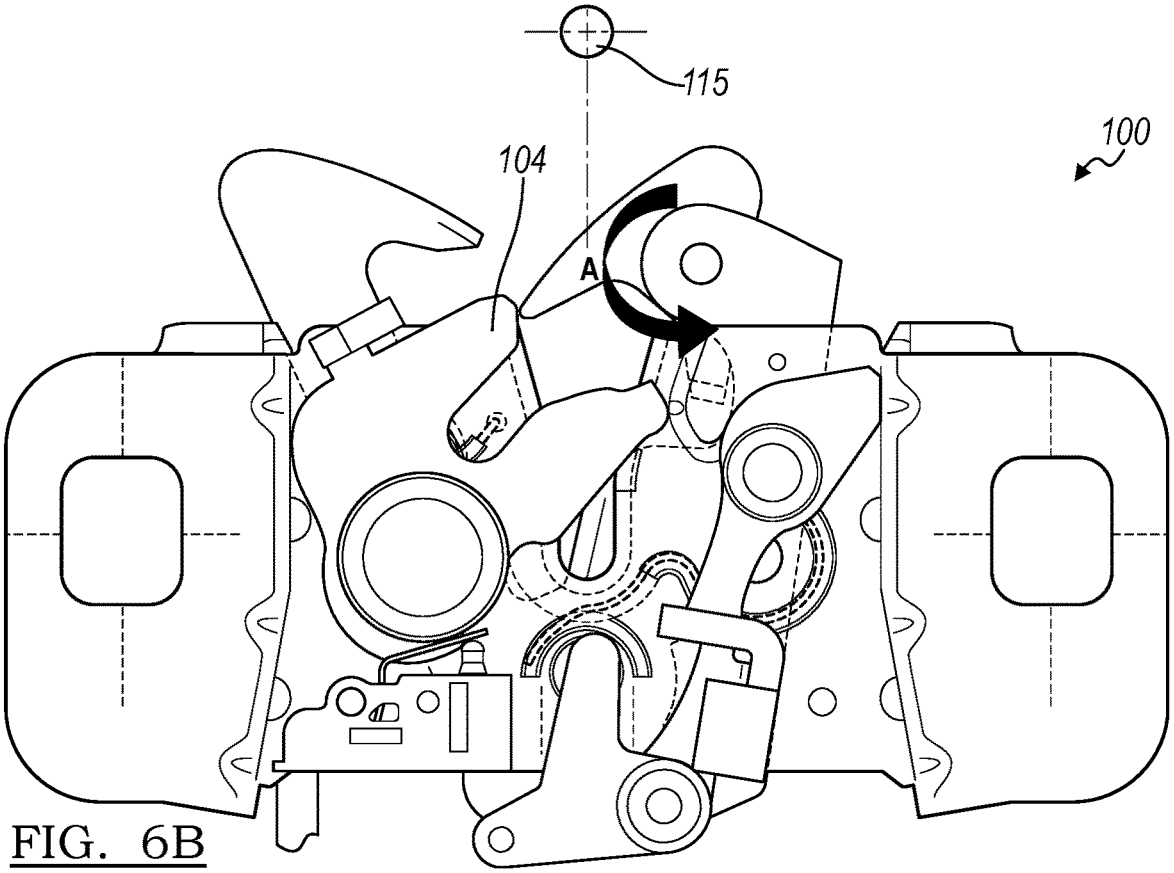

Alternatively, the latching mechanism 100 in the second actuated position, as shown in FIG. 4A-4B, may be transitioned into a fully unlatched position, as shown in FIGS. 6A-6B, by manually opening the hood of the vehicle to move the striker 115 apart from the latching mechanism 100. FIGS. 5A-5B shows the latching mechanism 100 transitioning from the second actuated position to the fully unlatched position. The striker 115 is held in position by the second biasing member 134 urging the first interior cam surface 140 of the cancel lever 132 against the striker 115. In the second actuated position, the hood may be manually lifted to overcome the biasing force of the second biasing member 134 such that the cancel lever 132 rotates out of the way of the path of the striker 115 as shown in FIGS. 5A-5B, thus disengaging the striker 115 from the cancel lever 132.

FIG. 6A-6B, the latching mechanism 100 is shown with the striker 115 in a fully unlatch position positioned apart from the latching mechanism 100, these enabling the full opening of the hood from the vehicle body. The biasing member urges the cancel lever 132 to rotate back to a position proximate the central region 102 of the latching mechanism 100 after the striker 115 is removed from the latching mechanism 100. As shown in FIG. 6A, the apex 139 extends sufficiently into the path of travel of the striker 115 along the A-axis when the latching mechanism 100 in the fully unlatched position such that the striker 115 will contact the exterior cam surface 138 upon the closing of the hood.

Figure 7B:
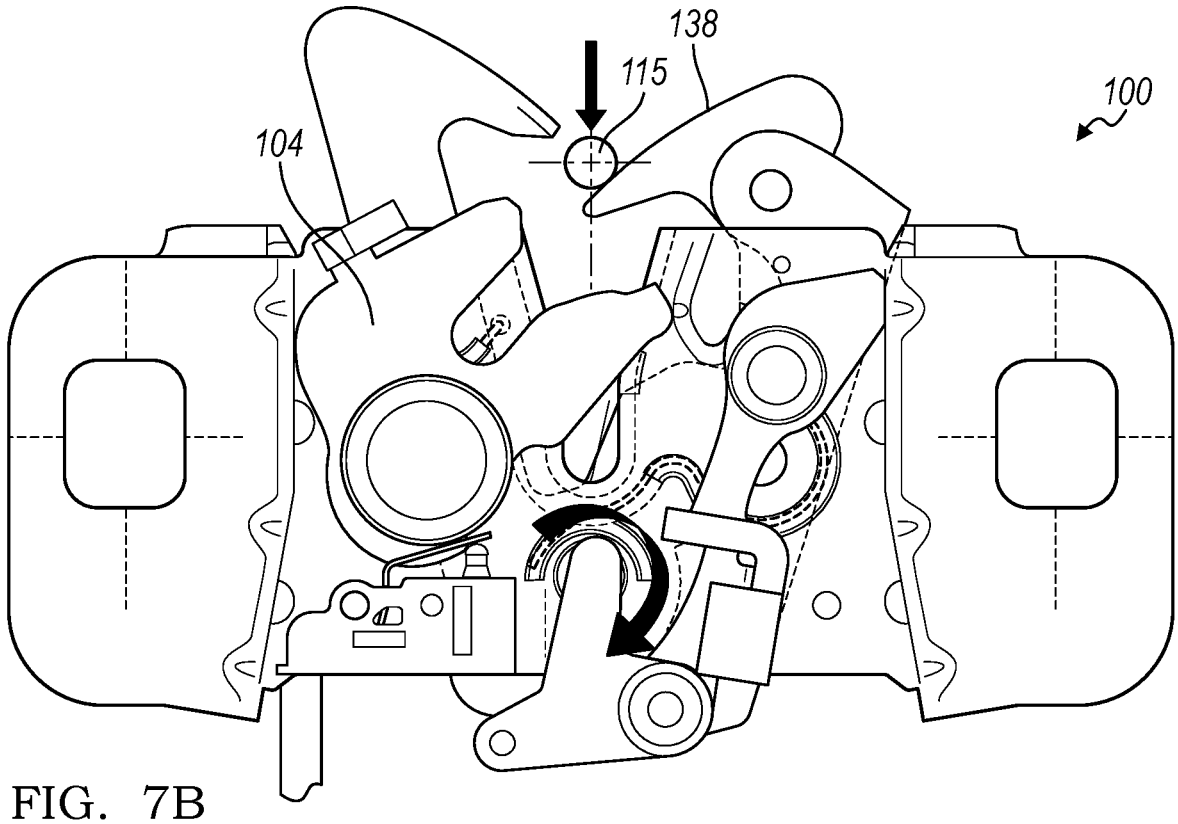

FIGS. 7A-7B illustrate the striker 115 and latching mechanism 100 as the hood panel 52 illustrated in FIG. 1 cooperating with the striker 115 is moved toward a position proximate the vehicle body 14 to secure the hood panel 52 to the vehicle 10. Striker 115 engages the exterior cam surface 138 of the cancel lever. The exterior cam surface 138 is configured such that a force applied along the A-axis onto the exterior cam surface 138 induces a moment M onto the second lever arm 118 causing the tab 136 to engage the second lever arm 118 causing the latch member 102 to rotate in a second direction, counter-clockwise as shown in FIG. 7A.

Figure 8A:
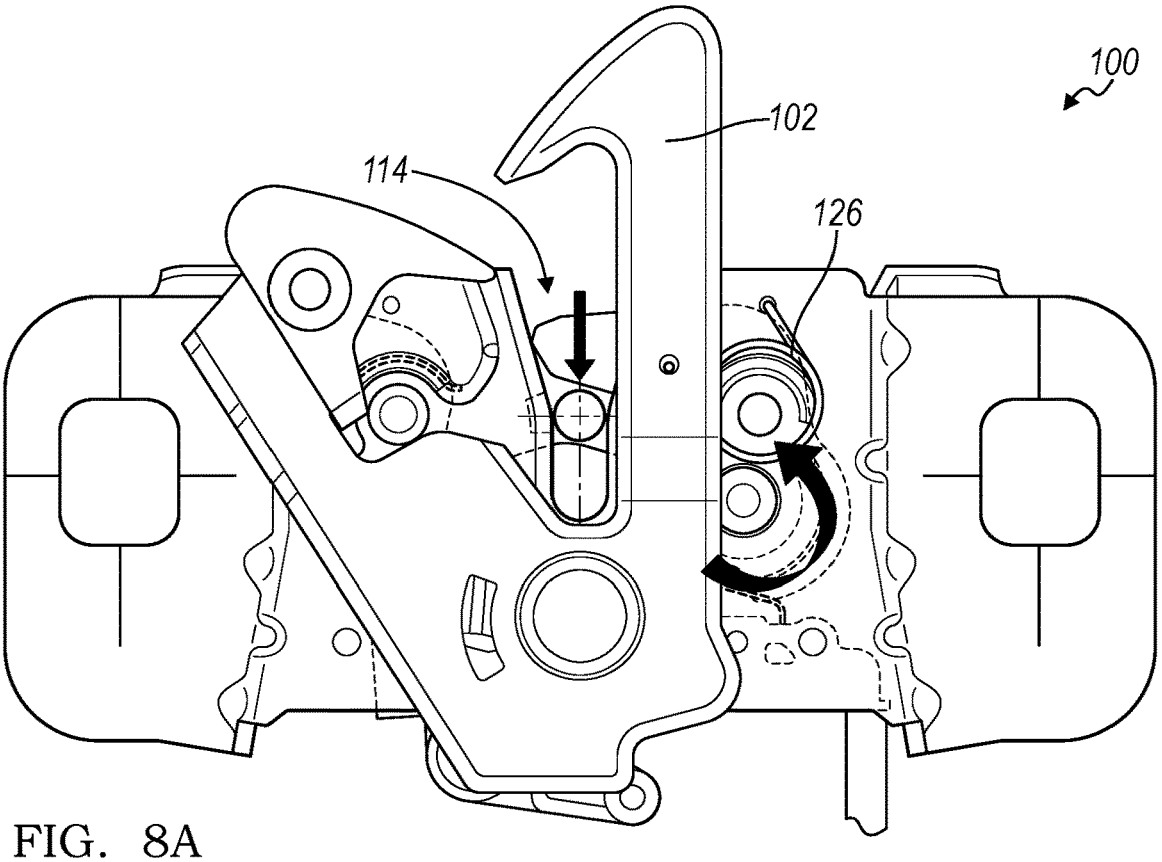
FIGS. 8A-8B are schematic front and rear views of the latching mechanism transitioning from the first actuated position to the fully latched position.
Figure 8B:
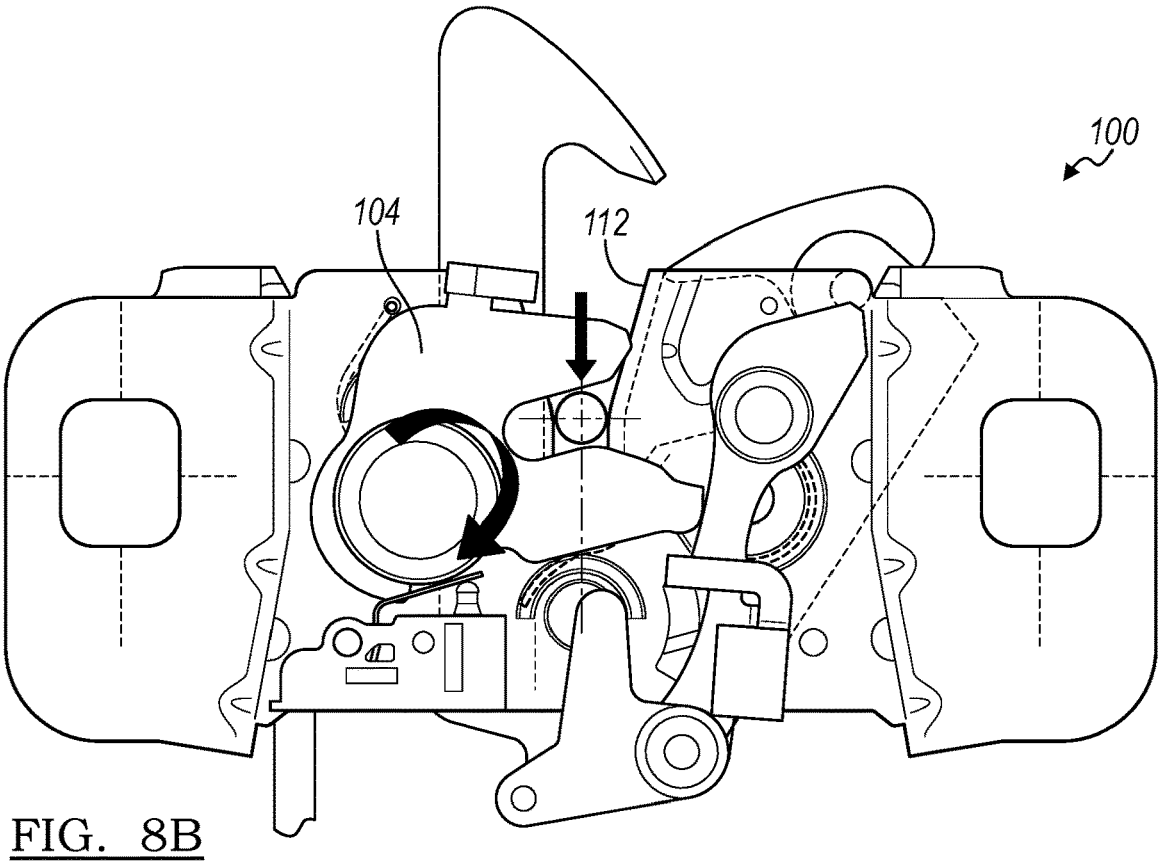

As shown in FIGS. 8A-8B, the latch member 102, the latching mechanism 100 is shown in the first re-latched position as the striker 115 is positioned in the latching mechanism 100 to re-latch the striker 115 in the fork bolt 104. The fork bolt 104 is positioned on the housing 106 such that the fork bolt 104 is aligned with the at least one cam surface 112. When the hood 52 is positioned adjacent the vehicle body 14, the striker 115 travels through the striker channel 114 into and a portion of the fork bolt 104 to place the fork bolt 104 in the latched position as shown in FIG. 2B. The striker 115 further engages the cam surface 112 of the latch member 102 and cooperates with the first biasing member 126 to reposition the latch member 102 from the unlatched position to the fully latched position, and thereby, the secondary catch portion 124 of the latch member 102 is placed proximate the central region of the housing 106 and latching mechanism 100.

Figure 9:
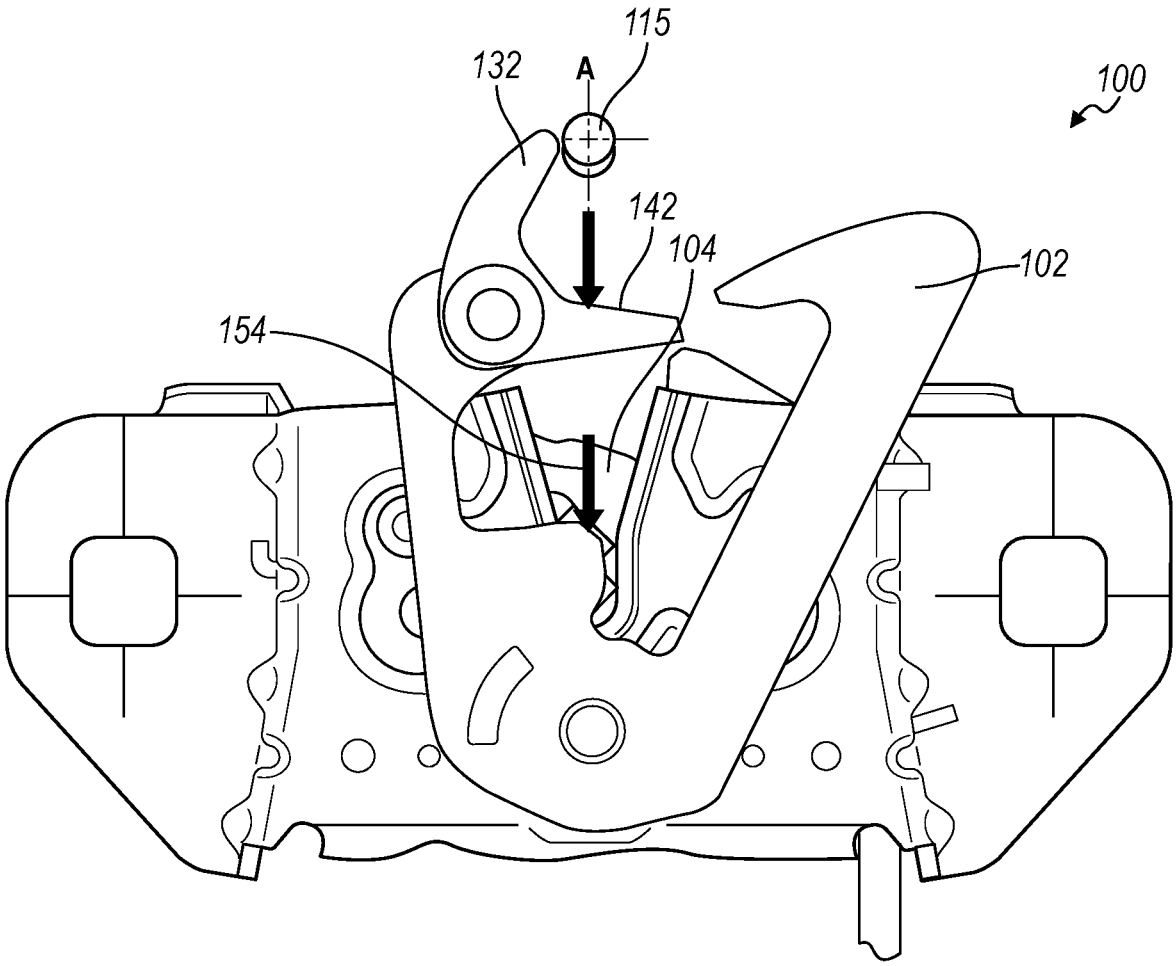
FIG. 9 is a schematic front view of the latching mechanism having a faulted cancel lever transitioning from the fully unlatched position to the first actuated position.

Referring to FIG. 9, the latching mechanism 100 is shown having a faulted cancel lever 132 transitioning from the fully unlatched position to the first actuated position. The faulted cancel lever 132 is shown stuck in the open position exposing the second interior surface 142 to the striker 115. When the striker 115 is moved toward a position proximate to the vehicle body 14 to secure the hood panel 52, the striker 115 engages the second interior cam surface 142 thereby rotating the cancel lever 132 in the closed position, also referred to as resetting the cancel lever 132. The striker 115 then engages the latch cam surface 154 and then into the fork bolt channel 146, thereby causing both the latch member 102 and fork bolt 104 to rotate back into the fully latch position as shown in FIGS. 2A-2B.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A vehicle comprising:

a vehicle body defining a compartment;

a hood panel adjustably mounted to the vehicle body and configured to selectively cover and uncover the compartment, the hood panel includes a striker; and a latching mechanism releasably engaging the striker, the latching mechanism comprises:

a housing secured to the vehicle body, wherein the housing includes a first side, an opposing second side, and a housing cam surface extending between the first side and second side in a central region of the housing, wherein the housing cam surface defines a striker channel extending along an axis;

a latch member pivotally connected to the first side of the housing, the latch member includes a first lever arm, a second lever arm extending from the first lever arm at an acute angle, and a latch side surface extending along the first lever arm and the second lever arm;

wherein the latch side surface defines a primary catch portion adjacent the striker channel between an intersection of the first lever arm and the second lever arm, a secondary catch portion on the first lever arm facing the primary catch portion, and a latch cam surface on the second lever arm proximal to the primary catch portion, wherein the latch member is selectively pivotable between a first position, where the primary catch portion and the second catch portion are aligned with the striker channel along the axis, and a second position, where the primary catch portion and the second catch portion are not aligned with the striker channel along the axis; and wherein the latch cam surface is configured such that a force applied along the axis onto the latch cam surface, when the latch member is in the second position, causes the latch member to pivot to the first position; and wherein the latching mechanism further comprises:

a first biasing member operating bi-directionally and applying a force to selectively preload the latch member to selectively rotate in opposing directions;

a cancel lever pivotally mounted to an end of the second lever arm of the latch member, so as to be spaced apart from the primary catch portion of the latch member, wherein the cancel lever includes a tab extending from the cancel lever; and a second biasing member urging the cancel lever to pivotally rotate in a first rotational direction causing the tab to engage the second lever arm, thus limiting a pivoting of the cancel lever in the first rotational direction.

2. The vehicle of claim 1, wherein the cancel lever further includes an exterior cam surface configured such that a force applied along the axis onto the exterior cam surface, when the latch member is in the second positon, induces a moment onto the second lever arm causing the latch member to rotate into the first position.

3. The vehicle of claim 2, wherein the exterior cam surface of the cancel lever transitions through an apex to a first interior cam surface, wherein the apex extends sufficiently into the striker channel when the latch member is in the second positon such that the striker contacts the exterior cam surface upon a closing of the hood panel.

4. The vehicle of claim 3, wherein first interior cam surface transitions to a second interior cam surface such that the first interior cam surface faces in a direction away from the exterior cam surface and toward the second interior cam surface.

5. The vehicle of claim 4, wherein the cancel lever is configured to rotate in the first rotational direction when the striker engages the exterior cam surface as the striker is moved toward the striker channel, thereby allowing the striker to engage the latch cam surface.

6. The vehicle of claim 4, wherein the cancel lever is configured to rotate in a second rotational direction opposite the first rotational direction when the striker engages the first interior cam surface as the striker is moved apart from the striker channel, thereby disengaging the striker from the latching mechanism.

7. The vehicle of claim 6, wherein the latching mechanism further comprises a fork bolt adjustably connected to the second side of the housing and movable between a latched position, wherein the fork bolt releasably secures the striker to fasten the hood panel to the vehicle body, and a first actuated position, wherein the striker is adjustable relative to the housing.

8. The vehicle of claim 7, wherein the second biasing member includes sufficient biasing force to urge the first interior cam surface of the cancel lever against the striker in the first rotational direction, when the latching mechanism is in a second actuated state with the latch member is in the second position, thus requiring the hood panel to be lifted to overcome the biasing force of the second biasing member such that the cancel lever rotates in the second rotational direction.

9. A latching mechanism to releasably engage a striker of a hood panel to a vehicle body, the latching mechanism comprising:

a housing securable to the vehicle body, the housing includes a first side, an opposing second side, and at least one housing cam surface;

a latch member pivotally connected to the first side of the housing, the latch member includes a first lever arm, a second lever arm extending from the first lever arm at an acute angle, and a latch side surface extending along the first lever arm and the second lever arm;

a first biasing member operating bi-directionally and applying a force to selectively preload the latch member to selectively rotate in a first direction and in a second direction opposite the first direction;

a cancel lever pivotally mounted to an end of the second lever arm of the latch member, wherein the cancel lever includes an extending tab;

a second biasing member urging the cancel lever to rotate in a first rotational direction causing the tab to engage the second lever arm, and thus limiting a rotation of the cancel lever in the first rotational direction;

a fork bolt adjustably connected to the second side of the housing and movable between a fully latched position, wherein the fork bolt engages the striker of the hood panel to the vehicle body, and a first actuated position, wherein the striker is released from engagement with the fork bolt; and a third biasing member biasing the fork bolt to rotate from the fully latched position to the first actuated position.

10. The latching mechanism of claim 9, wherein:

the at least one housing cam surface defines a striker channel extending along an axis, wherein the striker channel is configured to receive and guide the striker; and the cancel lever includes an exterior cam surface configured such that a force applied along the axis onto the exterior cam surface, when the latch member is in a second positon, induces a moment onto the second lever arm causing the latch member to rotate into a first position.

11. The latching mechanism of claim 10, wherein the latch side surface defines a primary catch portion adjacent the striker channel between an intersection of the first lever arm and the second lever arm, a secondary catch portion on the first lever arm facing the primary catch portion, and a latch cam surface on the second lever arm proximal to the primary catch portion.

12. The latching mechanism of claim 11, wherein:

the latch member is selectively rotatable between the first position, where the primary catch portion and the second catch portion are aligned with the striker channel along the axis, and a second position, where the primary catch portion and the second catch portion are not aligned with the striker channel along the axis; and the latch cam surface is configured such that a force applied along the A axis axis onto the latch cam surface, when the latch member is in the second position, causes the latch member to rotate to the first position.

13. The latching mechanism of claim 12, wherein the exterior cam surface of the cancel lever transitions through an apex to a first interior cam surface, and the first interior cam surface transitions to a second interior cam surface such that the first interior cam surface faces in a direction away from the exterior cam surface and toward the second interior cam surface.

14. The latching mechanism of claim 13 further comprising:

a device disposed on the housing and configured to adjust the fork bolt from the fully latched position to the first actuated position; and an actuator cooperating with the device and including a projection to engage the latch member, so as to rotate the latch member from the first position to the second position.

15. A latching mechanism to releasably engage a striker of a hood panel to a vehicle body, the latching mechanism comprising:

a housing secured to the vehicle body, wherein the housing includes a first side, an opposing second side, and a housing cam surface extending between the first side and second side in a central region of the housing, wherein the housing cam surface defines a striker channel extending along an axis configured to receive and guide the striker;

a fork bolt adjustably connected to the second side of the housing and movable between a locked position, wherein the fork bolt releasably engages the striker of the hood panel to the vehicle body, and an unlocked position, wherein the striker is adjustable relative to the housing;

a device disposed on the housing and configured to adjust the fork bolt from the locked position to the unlocked position;

a latch member pivotally connected to the first side of the housing, the latch member includes a first lever arm, a second lever arm extending from the first lever arm at an acute angle, and a latch side surface extending along the first lever arm and the second lever arm, wherein the latch side surface defines a primary catch portion adjacent the striker channel between an intersection of the first lever arm and the second lever arm, a secondary catch portion on the first lever arm facing the primary catch portion, and a latch cam surface on the second lever arm proximal to the primary catch portion, and wherein the latch member is selectively rotatable between a first position, where the primary catch portion and the second catch portion are aligned with the striker channel along the axis, and a second position, where the primary catch portion and the second catch portion are not aligned with the striker channel along the axis;

an actuator cooperating with the device including a projection to engage the latch member and rotate the latch member from the first position to the second position;

a cancel lever pivotally mounted to an end of the second lever arm of the latch member, so as to be spaced apart from the primary catch portion of the latch member, wherein the cancel lever includes a tab extending from the cancel lever; and a second biasing member urging the cancel lever to rotate in a first rotational direction causing the tab to engage the second lever arm thus limiting a rotation of the cancel lever.

16. The latching mechanism of claim 15, wherein the cancel lever further includes an exterior cam surface configured such that a force applied along the axis onto the exterior cam surface, when the latch member is in the second positon, induces a moment onto the second lever arm causing the latch member to rotate into the first position.

17. The latching mechanism of claim 15, wherein the cancel lever further includes a first interior cam surface opposing the exterior cam surface, and the cancel lever is rotatable in a second rotational direction opposite the first rotational direction when a sufficient force is applied to the first interior cam surface to overcome the basing force of the second biasing member.

* * * * *